US006254401B1

(12) United States Patent
Lee

(10) Patent No.: US 6,254,401 B1
(45) Date of Patent: Jul. 3, 2001

(54) BRIDGE TYPE CONNECTING STRUCTURE FOR TERMINALS OF COMPUTER EXPANSION CARTRIDGE

(76) Inventor: Yu-Tsan Lee, 9th Floor, No. 96, Der Hwa Street, Tau Yuan City, Tau Yuan Hsien (TW)

( * ) Notice: Subject to any disclaimer, the term of this patent is extended or adjusted under 35 U.S.C. 154(b) by 0 days.

(21) Appl. No.: 09/612,446

(22) Filed: Jul. 7, 2000

(51) Int. Cl.[7] ..... H01R 12/00
(52) U.S. Cl. ..... 439/79
(58) Field of Search ..... 439/131, 152–160, 439/43, 79, 80, 541.5, 74

(56) References Cited

U.S. PATENT DOCUMENTS 5,954,522 * 9/1999 Ho et al. ..... 439/79
6,089,915 * 7/2000 Ho et al. ..... 439/607
6,162,070 * 7/2000 Yu et al. ..... 439/108
6,183,271 * 2/2001 Yu ..... 439/79

* cited by examiner

*Primary Examiner*—Neil Abrams
*Assistant Examiner*—J. F. Duverne
(74) *Attorney, Agent, or Firm*—Rosenberg, Klein & Lee

(57) ABSTRACT

Bridge type connecting structure for terminals of computer expansion cartridge, including: an expansion cartridge, multiple terminals being implanted in rear side of the expansion cartridge with rear sections of the terminals horizontally outward projecting; and a terminal bridge seat connected with a circuit board, the edge of one side of the terminal bridge seat being formed with multiple terminal bridge dents side by side, a connecting terminal being implanted in each terminal bridge dent. The terminal bridge dents respectively correspond to the terminals of the expansion cartridge. The terminals of the expansion cartridge are respectively horizontally correspondingly bridged in the terminal bridge dents of the terminal bridge seat to electrically connect with the connecting terminals.

4 Claims, 3 Drawing Sheets

BRIDGE TYPE CONNECTING STRUCTURE FOR TERMINALS OF COMPUTER EXPANSION CARTRIDGE

BACKGROUND OF THE INVENTION

The present invention relates to a bridge type connecting structure for connecting with terminals of a computer expansion cartridge by way of bridging.

An existent notebook-type computer is generally equipped with at least one expansion cartridge for connecting with an external element such as a communication card, a web card, etc. As shown in FIGS. 1 and 2, the expansion cartridge 3 includes a cartridge main body defining therein a cartridge socket 31 in which the externally connected element is fitted. Multiple rows of terminals 32 are implanted in the rear side of the cartridge main body. The terminals 32 are bent to downward extend and respectively insert into the insertion holes 42 of a terminal connecting seat 4 so as to electrically connect with the connecting terminals 43 positioned in the insertion holes 42. The above connecting measure for the terminals 32 of the expansion cartridge 3 has some shortcomings as follows:

1. The rear section of each terminal 32 must be formed by another processing procedure which is difficult to perform. Therefore, the manufacturing procedure is time-consuming and the manufacturing cost is high.
2. The rear section of the terminals 32 is a bending section. During processing, a defective product is often produced. This leads to increment of cost.
3. The multiple terminals 32 are inserted into the insertion holes 42 on the same plane. During insertion, the terminals 32 are subject to bending due to deformation. This increases ratio of defective products.

SUMMARY OF THE INVENTION

It is therefore a primary object of the present invention to provide a bridge type connecting structure for terminals of computer expansion cartridge, including: an expansion cartridge, multiple terminals being implanted in rear side of the expansion cartridge with rear sections of the terminals horizontally outward projecting; and a terminal bridge seat connected with a circuit board, the edge of one side of the terminal bridge seat being formed with multiple terminal bridge dents side by side, a connecting terminal being implanted in each terminal bridge dent. The terminal bridge dents respectively correspond to the terminals of the expansion cartridge. The terminals of the expansion cartridge are respectively horizontally correspondingly bridged in the terminal bridge dents of the terminal bridge seat to electrically connect with the connecting terminals.

The present invention can be best understood through the following description and accompanying drawings wherein:

DETAILED DESCRIPTION OF THE PREFERRED EMBODIMENT

Figure 1:
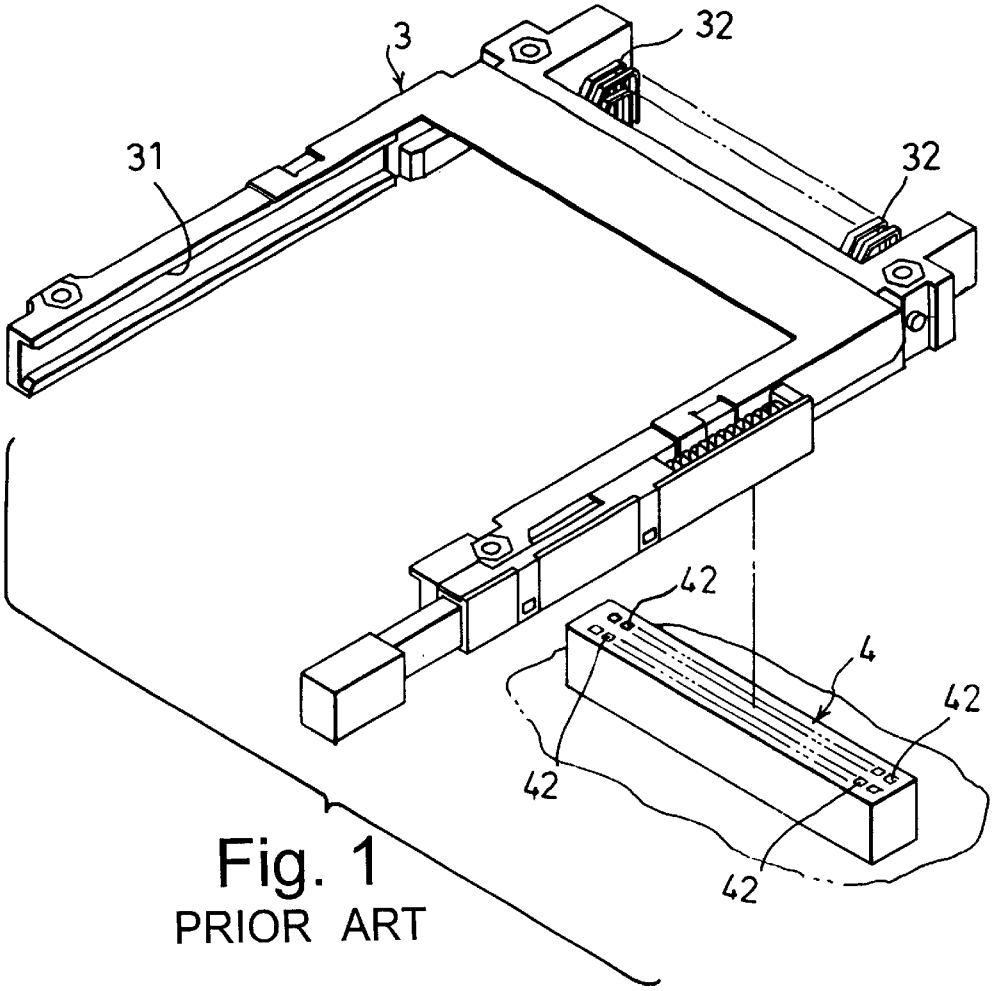
Fig. 1 PRIOR ART
FIG. 1 is a perspective exploded view of a conventional connecting structure for terminals of computer expansion cartridge.
Figure 2:
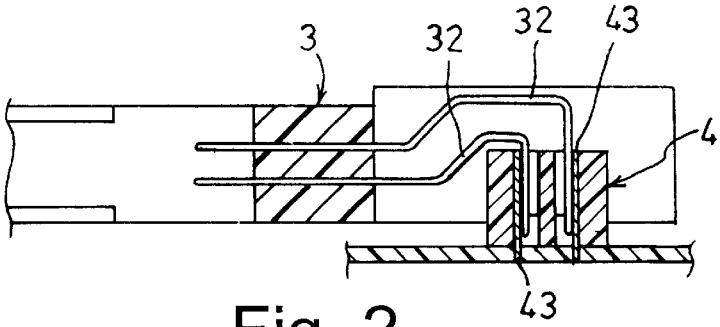
Fig. 2 PRIOR ART
FIG. 2 is a sectional view of the conventional connecting structure for terminals of computer expansion cartridge.

Please refer to FIGS. 3 to 6. The bridge type connecting structure for terminals of computer expansion cartridge of the present invention includes: an expansion cartridge 1, multiple terminals 12 being implanted in rear side of the expansion cartridge 1 with rear sections of the terminals 12 horizontally outward projecting; and a terminal bridge seat 2 connected with a circuit board 20, the edge of one side of the terminal bridge seat 2 being formed with multiple terminal bridge dents 22 side by side, a connecting terminal 23 being implanted in each terminal bridge dent 22, the terminal bridge dents 22 respectively corresponding to the terminals 12 of the expansion cartridge 1, whereby the terminals 12 of the expansion cartridge 1 are respectively correspondingly bridged in the terminal bridge dents 22 of the terminal bridge seat 2 to electrically connect with the connecting terminals 23.

The expansion cartridge 1 includes a cartridge body 11 defining an expansion socket 111 for snugly receiving therein an externally connected element such as a communication card, a web card, etc. Multiple terminals 12 are implanted in rear side of the cartridge body 11 with rear sections of the terminals 12 horizontally outward projecting. The front sections of the terminals 12 can be correspondingly inserted into the externally connected element. The terminals 12 are arranged into rows on the rear side of the cartridge body 11. The rows of terminals 12 are sequentially arranged from upper side to lower side as stages to outward project from the rear side of the cartridge body 11 by different lengths. The rows of terminals 12 are correspondingly bridged on the terminal bridge seat 2 stage by stage.

Figure 3:
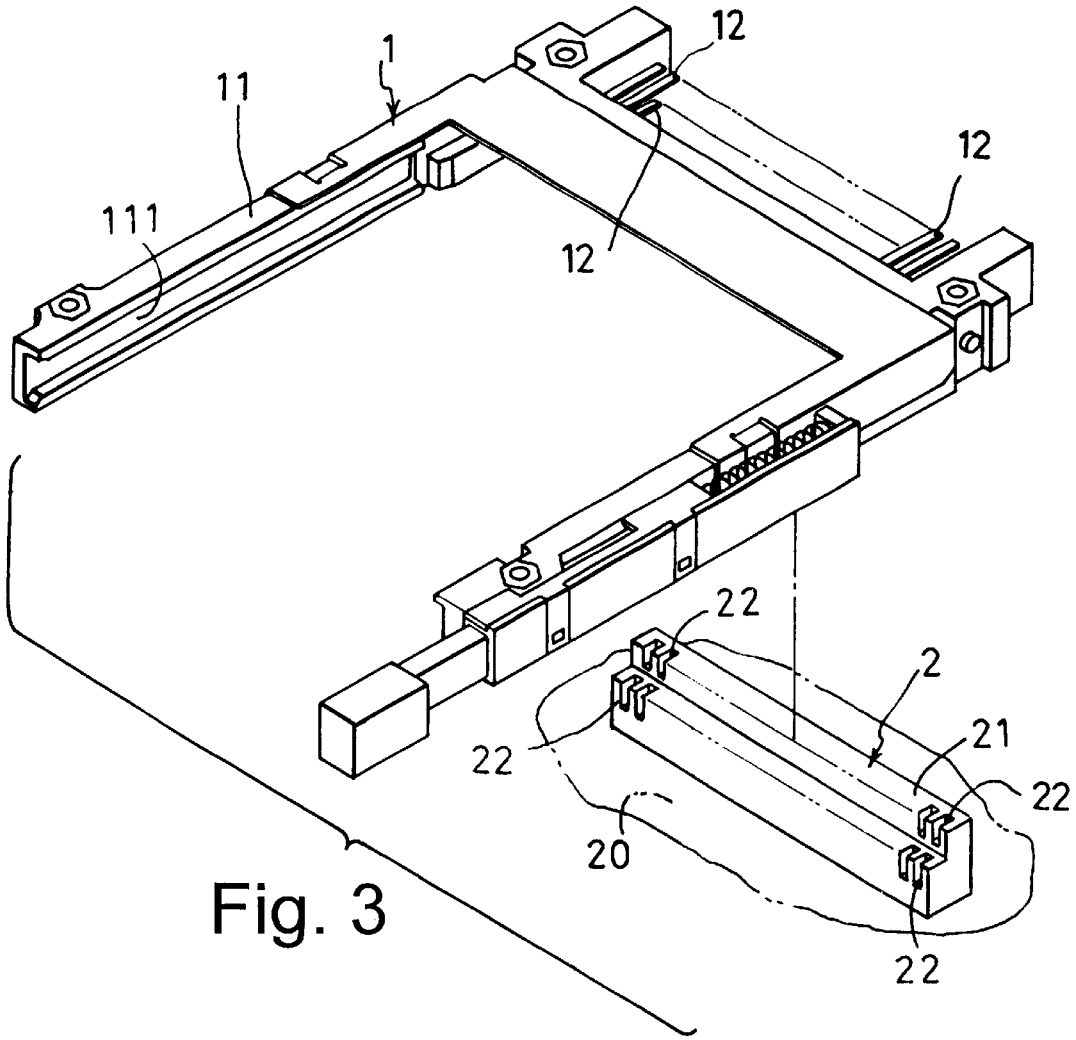
FIG. 3 is a perspective view of the present invention.
Figure 4:
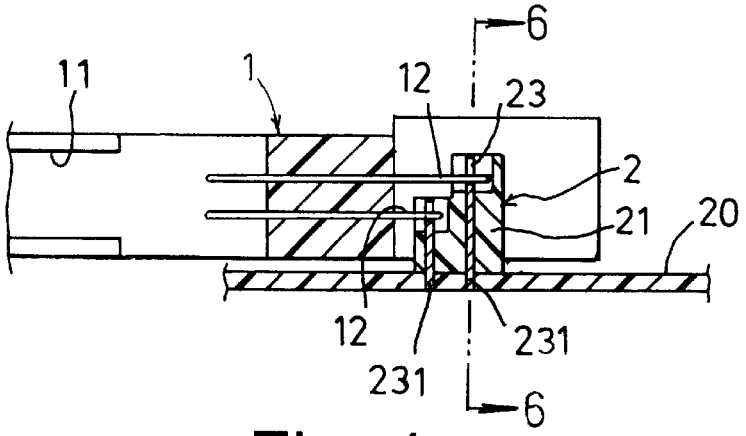
FIG. 4 is a sectional view of the present invention.

The terminal bridge seat 2 includes a main body 21. The edge of one side of the main body 21 is formed with multiple terminal bridge dents 22 side by side. A connecting terminal 23 is implanted in each terminal bridge dent 22. A contact pin 231 of tail end of each connecting terminal 23 is soldered on a circuit board 20. The main body 21 is a stepped body as shown in FIG. 3. The front edge of each stage is formed with multiple terminal bridge dents 22 side by side. The rows of terminals 12 of the expansion cartridge 1 are respectively correspondingly bridged in the terminal bridge dents 22 to electrically connect with the connecting terminals 23 in the terminal bridge dents 22.

Figure 5:
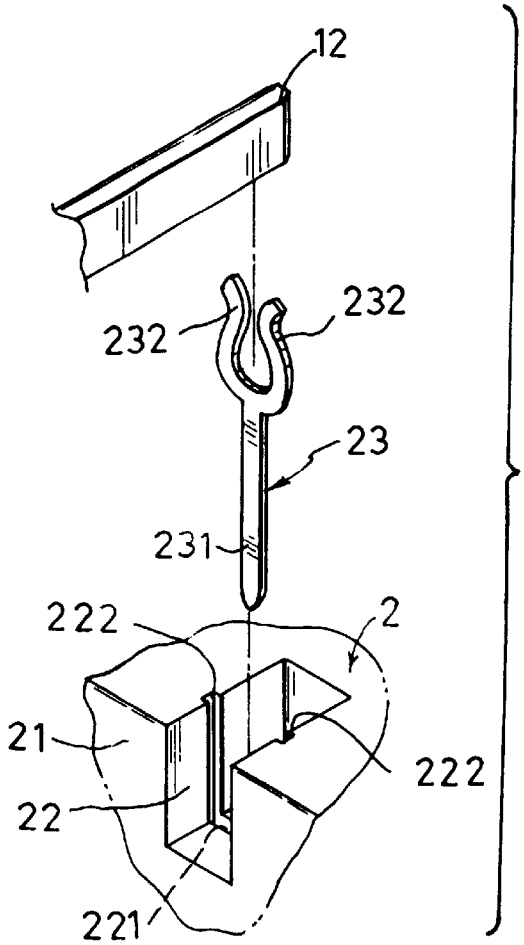
FIG. 5 is a perspective exploded view of a part of the terminal bridge seat of the present invention.
Figure 6:
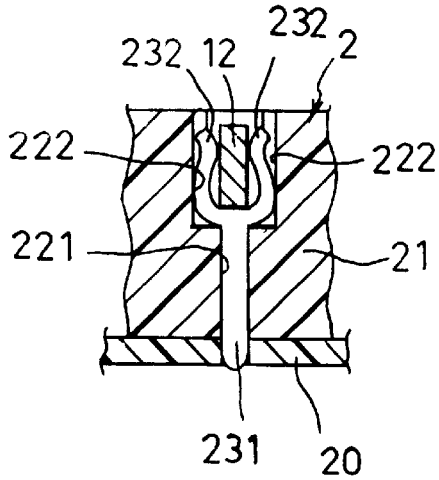
FIG. 6 is a sectional view taken along line 6—6 of FIG. 4.

Referring to FIGS. 5 and 6, the bottom end of each terminal bridge dent 22 is formed with a through hole 221 through which the contact pin 231 of the connecting terminal 23 is passed to be soldered on the circuit board 20. In addition, two side walls of the terminal bridge dent 22 are respectively formed with two clamping channels 222, whereby two sides of the connecting terminal 23 are firmly fitted in the clamping channels 222.

The connecting terminal 23 is made of electrically conductive sheet by way of integral punching, having a contact pin 231. Two clamping arms 232 respectively outward upward project from two sides of top end of the contact pin 231. The top sections of the two clamping arms 232 extend toward each other for resiliently clamping the terminal 12 of the expansion cartridge 1 bridged between the clamping arms 232.

When installed, the contact pins 231 of the tail ends of the connecting terminals 23 of the terminal bridge seat 2 are soldered on a circuit board 20 such as a main circuit board. Then the rows of terminals 12 of the expansion cartridge 1 are aimed at and bridged on the terminal bridge dents 22 of the terminal bridge seat 2. Then the expansion cartridge 1 is depressed to make the rear sections of the terminals 12 move downward to be firmly clamped between the clamping arms 232 of the connecting terminals 23. Therefore, the assembling operation of the present invention is very easy to complete.

The bridge type connecting structure for terminals of computer expansion cartridge of the present invention has the following advantages;

1. The terminal 12 implanted in the expansion cartridge 1 is formed with straight pattern without downward bending section. Therefore, the additional processing is omitted and the manufacturing procedure is simplified.
2. The assembling operation is easy to perform so that the ratio of defective products is lowered.

The above embodiment is only used to illustrate the present invention, not intended to limit the scope thereof. Many modifications of the above embodiment can be made without departing from the spirit of the present invention.

What is claimed is:

1. Bridge type connecting structure for terminals of computer expansion cartridge, comprising:

an expansion cartridge including a cartridge body defining an expansion socket for snugly receiving therein an externally connected element, multiple terminals being implanted in rear side of the cartridge body with rear sections of the terminals horizontally outward projecting, front sections of the terminals being correspondingly inserted into the externally connected element; and a terminal bridge seat connected with a circuit board, an edge of one side of the terminal bridge seat being formed with multiple terminal bridge dents side by side, a connecting terminal being implanted in each terminal bridge dent, the terminal bridge dents respectively corresponding to the terminals of the expansion cartridge, whereby the terminals of the expansion cartridge are respectively correspondingly bridged in the terminal bridge dents of the terminal bridge seat to electrically connect with the connecting terminals.

2. Bridge type connecting structure for terminals of computer expansion cartridge as claimed in claim 1, wherein the terminals of the expansion cartridge are arranged into rows and implanted in the rear side of the cartridge body, the rows of terminals being sequentially arranged from upper side to lower side as stages to outward project from the rear side of the cartridge body by different lengths, the rows of terminals being correspondingly bridged on the terminal bridge seat stage by stage.

3. Bridge type connecting structure for terminals of computer expansion cartridge as claimed in claim 1, wherein a bottom end of each terminal bridge dent is formed with a through hole through which a contact pin of a bottom section of the connecting terminal is passed to be soldered on the circuit board, two side walls of the terminal bridge dent being respectively formed with two clamping channels, whereby two sides of the connecting terminal are firmly fitted in the clamping channels.

4. Bridge type connecting structure for terminals of computer expansion cartridge as claimed in claim 1, wherein the connecting terminal is made of electrically conductive sheet by way of integral punching, having a contact pin, two clamping arms respectively outward upward project from two sides of top end of the contact pin, top sections of the two clamping arms extending toward each other for resiliently clamping the terminal of the expansion cartridge bridged between the clamping arms.

* * * * *